US009516711B2

(12) United States Patent
Weil et al.

(10) Patent No.: US 9,516,711 B2
(45) Date of Patent: Dec. 6, 2016

(54) CIRCUIT ARRANGEMENT FOR AN LED LIGHT SOURCE

(75) Inventors: Achim Weil, Immesheim (DE); Bjoern Bleisinger, Kirschroth (DE); Stefan Siebenrock, Karlsruhe (DE); Ulrich Schmitt, Deckenpfronn (DE)

(73) Assignee: SCHOTT AG, Mainz (DE)

( * ) Notice: Subject to any disclaimer, the term of this patent is extended or adjusted under 35 U.S.C. 154(b) by 398 days.

(21) Appl. No.: 13/509,475

(22) PCT Filed: Nov. 15, 2010

(86) PCT No.: PCT/EP2010/006934

§ 371 (c)(1),
(2), (4) Date: Aug. 29, 2012

(87) PCT Pub. No.: WO2011/057813

PCT Pub. Date: May 19, 2011

(65) Prior Publication Data

US 2012/0319612 A1 Dec. 20, 2012

Related U.S. Application Data

(60) Provisional application No. 61/261,518, filed on Nov. 16, 2009.

(30) Foreign Application Priority Data

Nov. 13, 2009 (DE) ..... 10 2009 052 836

(51) Int. Cl.
*H05B 37/00* (2006.01)
*H05B 33/08* (2006.01)

(52) U.S. Cl.
CPC ..... *H05B 33/0818* (2013.01)

(58) Field of Classification Search
CPC ..... H05B 37/00; H05B 33/0818; G05F 1/40; H02M 1/4225; H02M 1/4208; H02M 3/04; H02M 3/33592; H02M 7/44
(Continued)

(56) References Cited

U.S. PATENT DOCUMENTS 3,317,908 A * 5/1967 Hellmuth ..... 342/120
6,301,132 B1 * 10/2001 Vandelac ..... 363/56.01
(Continued)

FOREIGN PATENT DOCUMENTS

CN 1701482 A 11/2005
CN 101164031 A 4/2008
(Continued)

OTHER PUBLICATIONS

Author: Maxim Integrated, Title: Adding Extra Hysteresis to Comparators, p. 1-11 Date:Sep. 19, 2005.*
(Continued)

*Primary Examiner* — Douglas W Owens
*Assistant Examiner* — Wei Chan
(74) *Attorney, Agent, or Firm* — Ohlandt, Greeley, Ruggiero & Perle, LLP

(57) ABSTRACT

A light-emitting diode module is provided that includes a housing and a printed circuit board, which is connected to a light-emitting diode and which has an LED driver, a control module, and a circuit arrangement. The circuit arrangement has a DC/DC converter and a bypass connected in parallel to the DC/DC converter. The bypass is activatable by a comparator circuit. The comparator circuit is arranged between an input of the circuit arrangement and the DC/DC converter and detects the level of an input voltage of the circuit arrangement and compares it with a first and second threshold value. The comparator circuit activates the bypass when the input voltage is below the first threshold value and deactivates the bypass when the second threshold value is exceeded.

27 Claims, 10 Drawing Sheets

(58) Field of Classification Search
USPC ..... 323/265; 315/240, 247, 219; 363/50; 361/38
See application file for complete search history.

(56) References Cited

U.S. PATENT DOCUMENTS

| | | | | |
|---|---|---|---|---|
| 6,574,081 | B1 * | 6/2003 | Matsumoto et al. | 361/18 |
| 6,952,355 | B2 * | 10/2005 | Riggio et al. | 363/21.15 |
| 7,148,632 | B2 * | 12/2006 | Berman et al. | 315/189 |
| 7,507,001 | B2 * | 3/2009 | Kit | 362/276 |
| 7,629,778 | B2 * | 12/2009 | Liu | 323/222 |
| 7,710,253 | B1 * | 5/2010 | Fredricks | 340/464 |
| 7,733,617 | B2 * | 6/2010 | Baldwin et al. | 361/42 |
| 7,922,347 | B2 * | 4/2011 | Kaletin et al. | 362/33 |
| 7,986,287 | B2 * | 7/2011 | Umezaki et al. | 345/82 |
| 8,075,149 | B2 * | 12/2011 | Ko et al. | 362/95 |
| 8,080,983 | B2 * | 12/2011 | Lourens et al. | 323/275 |
| 8,159,690 | B2 * | 4/2012 | Motoyama | 358/1.13 |
| 8,184,419 | B2 * | 5/2012 | Peng | 361/93.9 |
| 8,384,367 | B2 * | 2/2013 | Murakami | H02J 7/0065 323/225 |
| 8,513,898 | B2 * | 8/2013 | Okawa et al. | 315/291 |
| 8,536,788 | B2 * | 9/2013 | Antony et al. | 315/50 |
| 8,598,805 | B2 * | 12/2013 | Tremblay et al. | 315/291 |
| 8,704,446 | B2 * | 4/2014 | Gibbs | 315/122 |
| 2002/0017284 | A1 * | 2/2002 | Masters | 123/597 |
| 2003/0021073 | A1 * | 1/2003 | Nagata | 361/78 |
| 2004/0233144 | A1 | 11/2004 | Rader et al. | |
| 2005/0128168 | A1 | 6/2005 | D'Angelo | |
| 2006/0006850 | A1 * | 1/2006 | Inoue et al. | 323/265 |
| 2006/0109205 | A1 | 5/2006 | Deng | |
| 2006/0220570 | A1 | 10/2006 | Evans et al. | |
| 2007/0046590 | A1 * | 3/2007 | Umezaki et al. | 345/76 |
| 2007/0228999 | A1 * | 10/2007 | Kit | 315/291 |
| 2007/0236279 | A1 | 10/2007 | Novak | |
| 2008/0054862 | A1 | 3/2008 | Hara et al. | |
| 2008/0251690 | A1 | 10/2008 | Keiper et al. | |
| 2008/0253155 | A1 * | 10/2008 | Peng | 363/50 |
| 2008/0273317 | A1 * | 11/2008 | Kaletin et al. | 362/33 |
| 2008/0278092 | A1 * | 11/2008 | Lys et al. | 315/247 |
| 2008/0297060 | A1 * | 12/2008 | Ko et al. | 315/219 |
| 2009/0086248 | A1 * | 4/2009 | Motoyama | 358/1.13 |
| 2009/0180303 | A1 * | 7/2009 | Liu | 363/21.14 |
| 2009/0237055 | A1 | 9/2009 | Sakai et al. | |
| 2010/0039045 | A1 | 2/2010 | Siegmund et al. | |
| 2010/0109624 | A1 * | 5/2010 | Lourens et al. | 323/280 |
| 2011/0093296 | A1 * | 4/2011 | Klink | 705/3 |
| 2011/0101875 | A1 * | 5/2011 | Okawa et al. | 315/185 R |
| 2011/0273435 | A1 * | 11/2011 | Umezaki et al. | 345/214 |
| 2012/0139501 | A1 * | 6/2012 | Cintra et al. | 320/137 |
| 2013/0009559 | A1 * | 1/2013 | Niikura et al. | 315/201 |
| 2013/0015833 | A1 * | 1/2013 | George et al. | 323/311 |
| 2013/0307514 | A1 * | 11/2013 | O'Connell et al. | 323/312 |

FOREIGN PATENT DOCUMENTS

| | | | |
|---|---|---|---|
| DE | 102005016729 | B3 | 10/2006 |
| DE | 102006017048 | A1 | 10/2007 |
| DE | 102006038158 | A1 | 2/2008 |
| DE | 102007018224 | A1 | 10/2008 |
| EP | 1111492 | A1 | 6/2001 |
| EP | 2001132 | A1 | 12/2008 |
| WO | 2008098613 | A1 | 8/2008 |

OTHER PUBLICATIONS

International Search Report dated Mar. 4, 2011 corresponding to International Application No. PCT/EP2010/006934.

Written Opinion dated Mar. 4, 2011 corresponding to International Application No. PCT/EP2010/006934.

English Translation of Preliminary Report on Patentability dated Jul. 12, 2012 corresponding to International Application No. PCT/EP2010/006934.

English Translation of Chinese Office Action dated Aug. 4, 2014 corresponding to Chinese Application No. 2010800515331, 4 pages.

Second Chinese Office Action dated Feb. 25, 2015 corresponding to Chinese Application No. 201080051533.2 with English Translation, 16 pages.

Linear Technology, "LTM8020", Linear Technology Corporation, 2007, 33 pages.

* cited by examiner

CIRCUIT ARRANGEMENT FOR AN LED LIGHT SOURCE

The present invention relates to a light-emitting diode module with a circuit arrangement for driving an LED light source, which module is particularly suited for use in the aviation sector.

LED light sources are gaining increasing importance in the lighting sector. The relatively high efficiency as compared to conventional halogen lamps, and associated relatively low heat dissipation and their mechanical robustness, and the durability of the individual LEDs make them predestined in particular for use in the transport sector, for example as a lighting source in a passenger cabin in airplanes, ships, railroad cars, etc. Due to their spot-type light with a brightness of typically 150-250 lx at a distance of 40-50 cm, LED light sources are particularly suited as reading lights on passenger aircraft.

Due to their construction, light-emitting diodes provide for a comparatively wide range of functional designs and installation places of an individual lamp. In passenger aircraft, for example, the conventional halogen reading lights in the overhead area are being replaced by LED reading lights which are preferably attached directly to a passenger seat, via a gooseneck, and are equipped with an LED module in a light source head. Such a reading light is particularly characterized by its swivel options and associated flexible alignment of the light cone.

For setting a suitable operating point, the light-emitting diodes of a respective LED module usually require a driver circuit which adjusts a voltage supplied from an on-board electrical system to the forward voltage of an LED, and which controls the diode current to be constant.

In the aviation sector there are generally high EMC (electromagnetic compatibility) standards for the electrical and electronic equipment. The wire-bound interference and space-bound radiated interference has to comply with the aviation regulatory standards, such as RTCA-DO160, or with customer-specific requirements, such as D6-36440 of Boeing, or ABD0100 of Airbus. Therefore, known LED modules generally include linear voltage regulators which convert a voltage difference between the diode forward voltage and the voltage as provided by the on-board electrical system into dissipated power. The resulting dissipated heat from the LED module also has to comply with the limits prescribed by the standards. For example, the touch temperature of an aluminum housing of an LED module must not exceed the ambient temperature by more than 7° C.

In the entire aviation sector various types of DC electrical systems have been established, with different nominal voltages. While sport aircraft often have a 12 V/14 V DC electrical system, the passenger cabins of modern commercial aircraft are usually equipped with a 28 V DC electrical system. In addition to the 28 V voltage level, other supply voltages are increasingly provided at the same time, by a variety of power supplies. For example, so-called in-seat power supplies (ISPS) generate a local 5 V DC voltage which is provided, e.g. via a universal serial bus (USB), for consumer electronics integrated in the seat, inter alia, and by which optionally an LED reading light can be operated.

An LED module currently in use in aviation and having a linear voltage regulation, can only be used for a specific nominal voltage when accounting for a maximum tolerable power dissipation. To ensure such a low power dissipation, the LED lights designed for 28 V operation are preferably equipped with a multi-LED module that includes a plurality of LEDs connected in series. The series connection of multiple LEDs allows for a larger voltage drop, so that the linear voltage regulator has to dissipate less power. Single LED modules may currently be employed in the aviation sector only for low supply voltages. In contrast to multi-LED modules, they stand out due to their more homogeneous distribution of brightness in the light cone which makes their use desirable also at higher voltages.

A major drawback with the known LED lights is that for each of the different on-board electrical systems, i.e. for the different voltage ranges, a separate LED module has to be developed, with an adapted light-emitting diode configuration and an adapted voltage regulator. This is particularly disadvantageous in view of the time-consuming and technically complex certifications and inspections for aircraft approval. Moreover, for direct operation at an on-board electrical system it is important to consider specific requirements with regard to permanently and temporarily occurring overvoltages.

U.S. Pat. No. 7,148,632 B2 describes a light-emitting diode module which drives three groups of LEDs, each of which emits a different color of light and is adjustable in intensity. Procedures are provided that allow to calibrate color and power. This device includes a power module for a voltage range from 23 V to 33 V, which significantly limits its field of application.

US 2006/0220570 A1 shows a low cost module for LED power supply. Using a charge pump assembly, the voltage drop of a DC battery is to be compensated for and thereby the supply voltage is to be increased when battery voltage decreases. At sufficiently high battery voltage, the charge pump assembly is bypassed to avoid unwanted losses in the battery powered system. In particular from FIG. 2 of this publication it can be seen that this arrangement allows compensation in a voltage range from about 3.4 to 4.2 V, which is completely unsuitable for the purposes of, for example, the aviation industry.

US 2008/0054862 A1 describes an electronic device having a DC voltage supply wherein the voltage of a supplying battery is regulated for a load to be supplied by means of suitable converters.

Therefore, one object of the present invention, among others, is to provide a wide range voltage LED module, which in particular meets the requirements applicable in the aviation sector.

To achieve this object, the present invention proposes a light-emitting diode module comprising a housing and at least one printed circuit board, wherein the housing is preferably made of aluminum or a flame-resistant synthetic material. The circuit board includes at least one light-emitting diode, an LED driver, and a control module, and a circuit arrangement. The LED driver provides a constant operating point for pulsed operation of the light-emitting diode as controlled by the control module. The circuit arrangement comprises an input for applying a first voltage, and a DC/DC converter, and a bypass connected in parallel to the DC/DC converter and activatable by means of a comparator circuit.

In preferred embodiments, on the one hand the control module can be designed as a PWM module. This advantageously allows dimming of the LED.

In another embodiment, on the other hand the control module is formed as a mechanical switch or pushbutton, or can be actuated by means of a separate switch or pushbutton or through an external switching input.

The switch or pushbutton can, on the one hand, be formed as a mechanical switch or pushbutton, or as a semiconductor switch which is controllable by means of a micro-switch.

Advantageously, due to the very low switching currents very small micro-switches can be used, such as an D3SH type OMRON switch, for example.

The comparator circuit is preferably arranged between the input and the down-converter module, and is adapted to detect the level of an input voltage of the circuit arrangement and to compare it with a first and second threshold value.

The comparator circuit is further adapted to control the transistor to enable the bypass when the voltage falls below the first threshold value, and to control the transistor to disable the bypass when the voltage exceeds the second threshold value.

Thus, in contrast to the prior art, the present invention provides a general purpose light-emitting diode module that can be used as a light source in a variety of lighting equipment in the aviation sector. So the very complicated approval procedure for such electronic components has therefore only be performed once, which is especially advantageous in view of the small quantities that are typical in the aviation sector.

The wide voltage range of the light-emitting diode module offers the additional significant advantage that variations in the input voltage provided by the on-board electrical system are processed without variations in brightness of the light source. For example, if in case of a generator failure the on-board electrical system voltage of 28 V drops to the 24 V of battery power, the light-emitting diode module according to the invention provides its full light intensity even in emergency mode, which makes it suitable as a preferable entry light.

According to an advantageous embodiment, a DC/DC converter in form of an integrated down-converter module is employed.

In another particularly advantageous embodiment according to the invention, the printed circuit board of the light-emitting diode module is provided as a multi-part printed circuit board, the individual circuit board parts being connected by flexible sections of conductive traces. The circuit board parts may thus be installed in the housing of a light-emitting diode module in folded relationship and merely take a maximum volume of 12 cc.

In order to protect the downstream components against an overvoltage when operated at the on-board electrical system with a voltage applied for a longer period, the circuit arrangement advantageously includes an overvoltage protection circuit which comprises a field effect transistor which in the event of an overvoltage limits the supply voltage.

In a preferred embodiment of the light-emitting diode module, at least one suppressor diode, or at least one varistor, or a combination of suppressor diode and varistor is/are arranged between the input and the first filter circuit. Advantageously, suppressor diodes respond very quickly to an overvoltage, but can absorb relatively little energy; varistors, by contrast, respond a little slower, but can absorb more energy.

In a particularly preferred embodiment of the light-emitting diode module, a plurality of suppressor diodes and/or varistors are arranged at the output side and/or input side of the light-emitting diode and of other components of the LED printed circuit board, between the input and the first filter circuit, and/or between the input and the LED driver. In particular, in this especially preferred embodiment protection against overvoltages can be achieved which are induced/coupled-in between the LED printed circuit board and the main printed circuit board, e.g. as a result of radar radiation, EMPs or the like.

Other features and advantages of the invention will become apparent from the following detailed description of a preferred but merely exemplary embodiment of the invention with reference to the accompanying drawings.

In the drawings:

FIG. 1 shows the block diagram of a wide range voltage module, which is comprised by a light-emitting diode module having a single LED light source, according to the invention. The light-emitting diode module meets the requirements of RTCA-DO160E, and thus is particularly suited as a reading light or cabin lighting in the aviation sector.

The illustrated wide range voltage module includes a pair of input terminals X1.3 and X1.2 at which a DC voltage between 4.5 V and 32.5 V is applied from an on-board electrical system. The module comprises a single high-power light-emitting diode D11 which is operated with an LED driver U4 and a control module to be dimmable. The brightness is adjustable via a pushbutton or switch 12, or via an external actuation unit connectable at terminal X1.1.

A DC/DC converter U1 and a bypass 11 connected in parallel thereto provide a DC voltage in a range between 4 V and 8 V to supply the control module and the LED driver. At the input of the module, a filter and protection circuit is provided which filters overvoltages and high frequency interferences.

Figure 1:
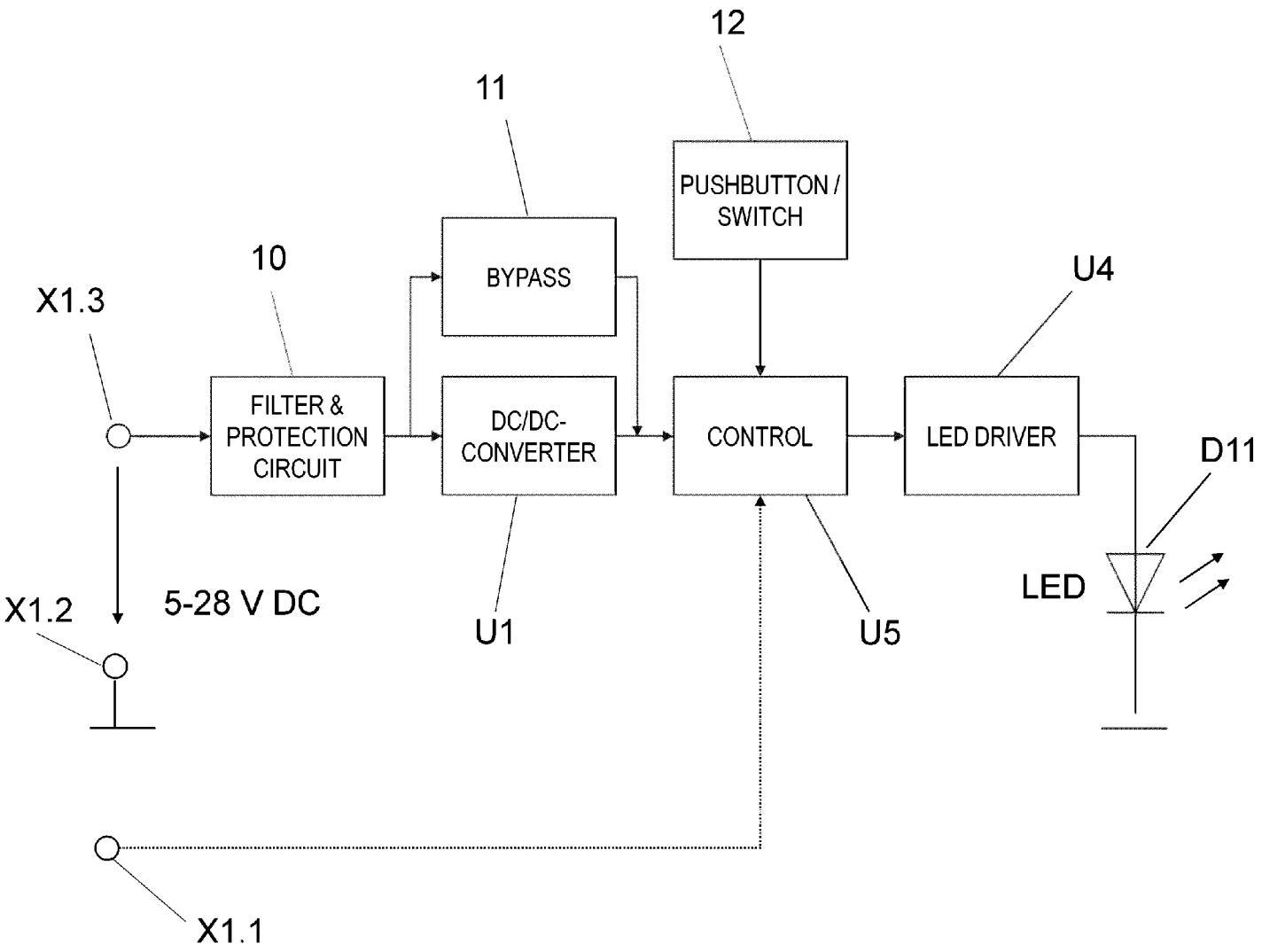
FIG. 1 is a block diagram of a wide range voltage module for a light-emitting diode module according to the invention.
Figure 2:
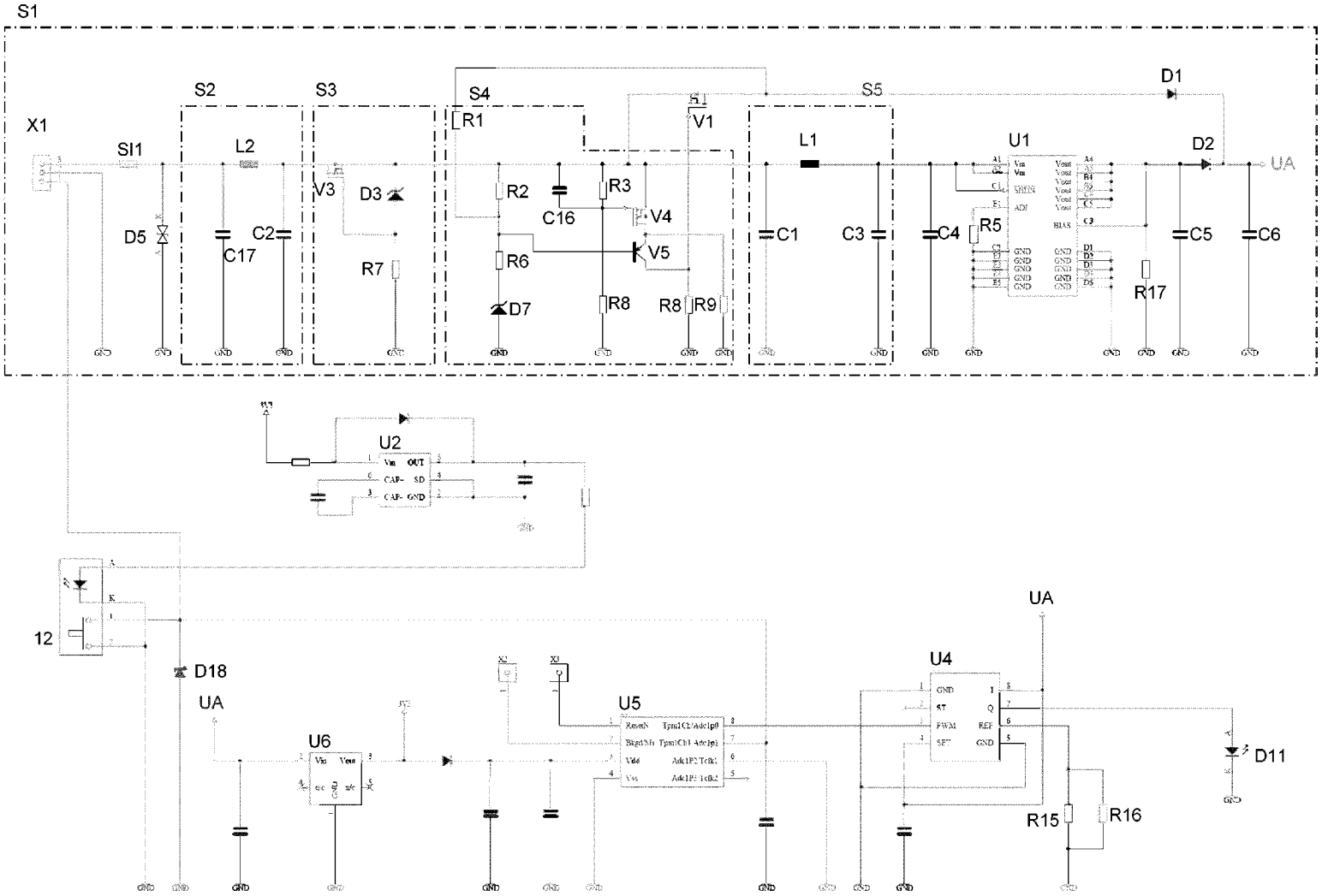
FIG. 2 is a detailed circuit diagram of a wide range voltage module according to FIG. 1.

FIG. 2 shows a detailed circuit diagram of a wide range voltage module. The illustrated circuit may essentially be divided into two parts wherein the upper part shows a voltage supply circuit S1 which provides a voltage UA between 4 V and 8 V DC at its output, and which can be operated universally at any input voltage in a voltage range from 4.5 V to 32.5 V DC. The lower part of FIG. 2 shows an LED driver circuit which includes all means for controlling the brightness of the high power light-emitting diode D11.

Power supply circuit S1 has a three pin connector X1 at its input side, an input voltage being provided at two of the electrical terminals, X1.3 and X1.2. This input voltage may be a 5 V DC voltage from an in-seat power supply (ISPS) which locally supplies infotainment systems integrated in a passenger seat, for example, or may be a 28 V DC voltage which is typically provided by an on-board electrical system in a cabin of a commercial aircraft and serves to supply various electrical loads. Terminal X1.2 provides the ground potential (GND) for the circuit, the positive input voltage potential is applied at terminal X1.3, this live input line being protected against overcurrents by a fuse SI1.

Moreover, voltage supply circuit S1 includes an overvoltage protection at its input region, which is suitable to filter transient voltage spikes that could be caused by switching operations within the on-board electrical system, for example. The overvoltage protection is preferably provided in form of a bidirectional suppressor diode whose operating and breakdown voltage is designed to correspond to the maximum input voltage of the voltage supply circuit.

Instead of or in addition to suppression diodes bidirectional ESD protection diodes can be used, since these diodes likewise provide very fast response times and low power losses.

Exemplarily, diode D18 in FIG. 2 is such a bidirectional ESD protection diode.

The output of voltage supply circuit S1 is preferably operated at a 4 V DC voltage that is provided by a DC/DC converter. To meet the requirements of the aviation standards for low interference emissions and sensitivity to interference, the invention proposes to provide a down-converter which is completely built as an integrated circuit U1 and has to be connected to ground capacitors C4, C5 at its input and output side, respectively. The output voltage of the down-converter is adjusted by resistor R5. Resistor R17 provides a basic load for the down-converter. Such a converter device, for example of the LTM8020 type, has the necessary inductance integrated therein. Due to the short wires in the wiring layer of an IC, the interference emission typically caused by a converter can be reduced to a minimum, so that there only remains a need to reduce the wire-bound interferences from the IC to the aviation requirements.

To this end, the circuit diagram of FIG. 2 comprises a first filter S2 in the voltage supply circuit S1, which is arranged at the input side downstream suppressor diode D5 and is composed of components C2, C17, and L2. An additional, second filter S5 is provided directly at the voltage input of the converter and comprises capacitors C1 and C3, and inductance L1.

In order to provide a desired output voltage of 4 V at the output of voltage supply circuit S1, the currently known integrated down-converters U1 require an input voltage of at least 7 V. In order to nevertheless cover the wide range of input voltages from 4.5 V to 32.5 V DC, voltage supply circuit S1 includes a bypass circuit which allows to directly relay an input voltage of up to about 4 V to the output, via MOS transistor V1, provided that is has a voltage level below the 7 V. Transistor V1 is controlled by a comparator circuit S4 that detects the applied input voltage and compares it with a threshold value below which the bypass is enabled.

Transistor V4 is coupled to the input circuit via a voltage divider comprising resistors R3 and R8, the voltage divider being dimensioned such that the transistor is conductive within the entire range of input voltages from 4.5 V to 32.5 V and provides a voltage for transistor V5. Capacitance C16 is provided in parallel to resistor R3, which capacitance, when high frequency signals are superimposed on the input DC voltage, changes the division ratio of the voltage divider such that the voltage drop across the parallel circuit consisting of R3 and C16 falls below the threshold voltage of transistor V4 and so shuts it down.

Detection of the switching threshold for the input voltage of the present voltage supply circuit S1 is provided by transistor V5, resistors R2 and R6, and zener diode D7. With an input voltage between 32.5 V and about 7.5 V, a voltage drop that occurs across resistor R2 which is connected in parallel to the base-emitter diode of transistor V5 is sufficiently large to switch the transistor on. When the voltage falls below the 7.5 V, transistor V5 blocks and the gate potential of transistor V1 is pulled to ground (GND). The negative gate-source voltage so applied, which is below the threshold voltage of PMOS transistor V1, switches the transistor on, so that the bypass circuit is enabled.

A resistor R1 is connected to the drain terminal of the transistor, which resistor is connected to resistors R2 and R6 of the switching threshold detection means. When transistor V1 is on, resistor R1 forms a parallel circuit with resistor R2, so that the division ratio in the switching threshold detection circuit is altered such that in order for transistor V5 to become conductive again, an input voltage of at least 8 V has to be applied.

Thus, a hysteresis of approximately 0.5 V is provided for enabling/disabling the bypass circuit, which in the transition region effectively suppresses an uncontrolled switching back and forth of the bypass circuit similar to that of an astable multivibrator, should an input voltage be in the range of the switching threshold.

At the output of voltage supply circuit S1, two decoupling diodes D1 and D2 are provided, which decouple the bypass circuit and the converter module from each other. The voltage supply circuit thus provides a voltage between 4 V and 8 V DC which is provided via the converter module or via the bypass circuit, in function of the input voltage.

The lower part of the circuit diagram of the wide range voltage module illustrated in the FIG. 2 illustrates a control circuit for a single LED light source. It comprises an LED driver module U4 which operates LED D11 in pulsed manner at a constant operating point of its V-I characteristics, and is directly operated by a voltage between 4 V and 8 V DC from the voltage supply circuit. The basic settings for the LED current is effected by means of resistors R15 and R16 which define a basic brightness of the light-emitting diode D11. This basic brightness of light-emitting diode D11 can be altered through a variable PWM signal that is provided to the driver module by a PWM module. This PWM module may, for example, be provided in form of a microcontroller U5, a desired level of LED brightness being adjustable using a pushbutton 12.

Microcontroller U5 is supplied with a 3 V DC voltage from voltage regulator module U6 which also provides the operating voltage for a driver circuit U2. Driver circuit U2 drives a standard LED which is integrated in pushbutton 12 as a lighting means.

Terminal X1.1 of the wide range voltage module permits to adjust or alter the brightness via an external, second actuating unit that has a similar function as pushbutton 12.

Figure 3:
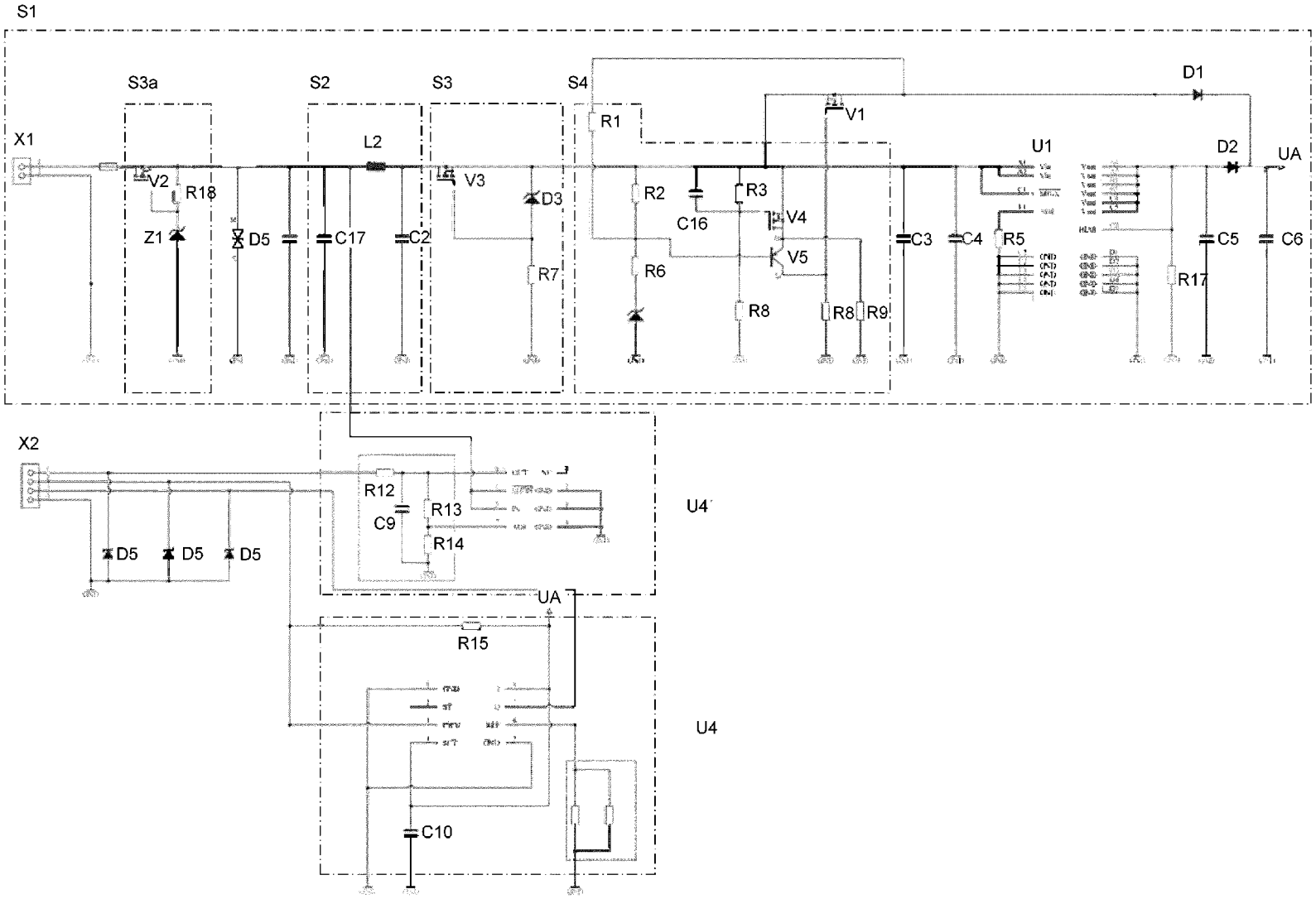
FIG. 3 is a detailed circuit diagram of an alternative wide range voltage module according to FIG. 1.

FIG. 3 illustrates a circuit diagram of another embodiment of the light-emitting diode module.

In this light-emitting diode module, circuit arrangement S1 comprises an overvoltage protection circuit S3*a* which includes a field effect transistor V2, see FIG. 3, which in an overvoltage event limits the supply voltage. To this end, as shown in FIG. 3, the gate of field effect transistor V2 is connected to zener diode Z1 and resistor R18, so that in an overvoltage event at input X1 the transistor is driven to high impedance and thereby limits the supply voltage applied to modules arranged downstream thereof, and in particular limits it to levels that are harmless for the downstream modules.

Due to the low power dissipation of field effect transistor V2, the downstream components can be safely protected against overvoltages when operated at the on-board electrical system, even if an overvoltage is applied for a longer time, and even in case of a failure enhanced availability of the light-emitting diode module is ensured.

The light-emitting diode module depicted in FIG. 3 includes at least one suppressor diode D5, or at least one varistor, or a combination of suppressor diodes and varistors, not shown in the drawings except of diodes D5, which are arranged between input X1 and the first filter circuit S2. The varistors may be included instead or in addition to diodes D5. If these varistors are used in the circuit in addition to diodes D5, they are connected in parallel to these diodes D5.

In a preferred embodiment, these diodes D5 may be bidirectional ESD protection diodes, such as those marketed by Phillips Semiconductors under the name of PESD5V0S1BA/BB/BL, for example.

Figure 4:
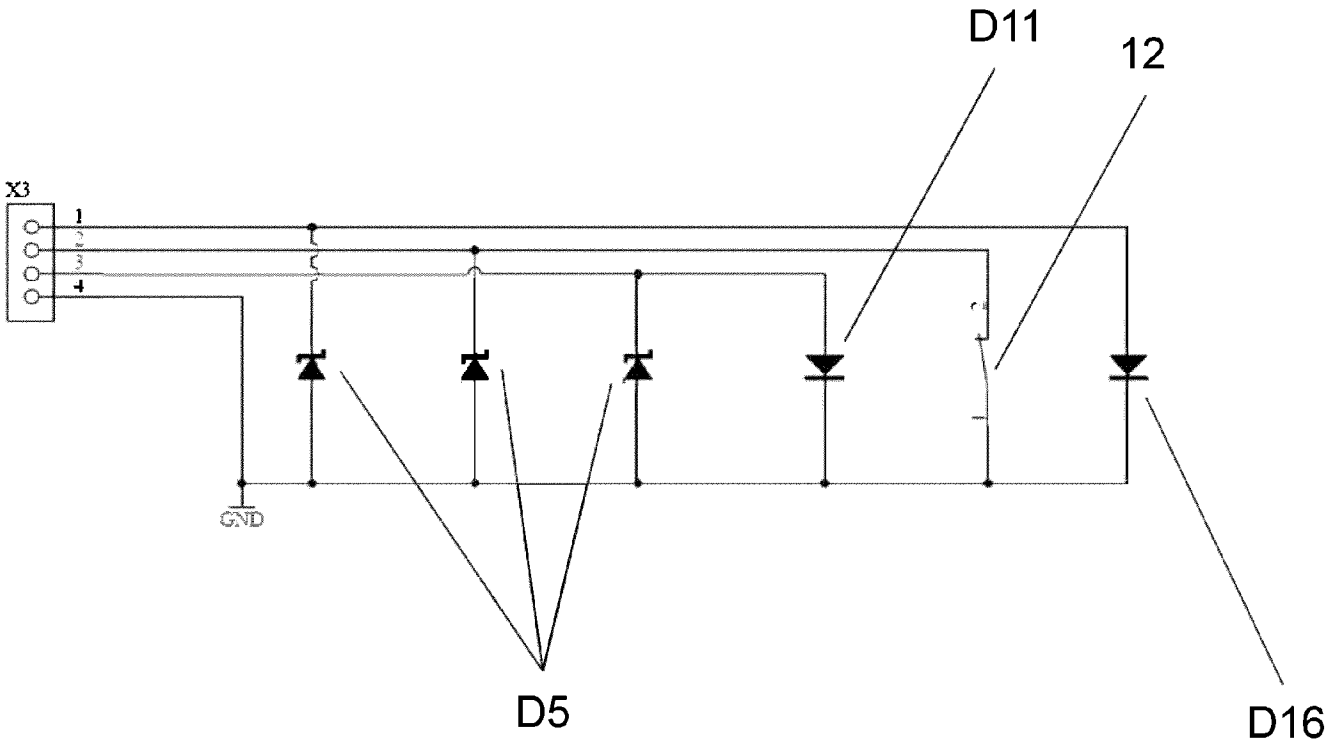
FIG. 4 is a circuit diagram of an LED printed circuit board.

Furthermore, a plurality of suppressor diodes and/or varistors may be arranged at the output side and/or the input side of light-emitting diode D11, see FIG. 4, and of other components of the LED printed circuit board, between input X1 and the first filter circuit S2, and/or between input X2 and LED driver U4.

Circuit U4' in FIG. 3 is an example of a driver circuit for diode D11 which is used for pushbutton backlighting.

FIG. 4 shows an example of three suppressor diodes D5 which are connected in parallel to light-emitting diode D11, in parallel to the switch or pushbutton 12, and in parallel to light-emitting diode D16 which serves for push button illumination.

The low electromagnetic interference emission required in the aviation sector is ensured by an aluminum housing which is grounded at low impedance and encloses the circuit including the light-emitting diode.

In a preferred embodiment, the housing including the entire circuit can be installed in a 12 cc. sized head of a reading lamp.

As an alternative to aluminum, the housing may also be made of flame-resistant plastics.

Figure 5:
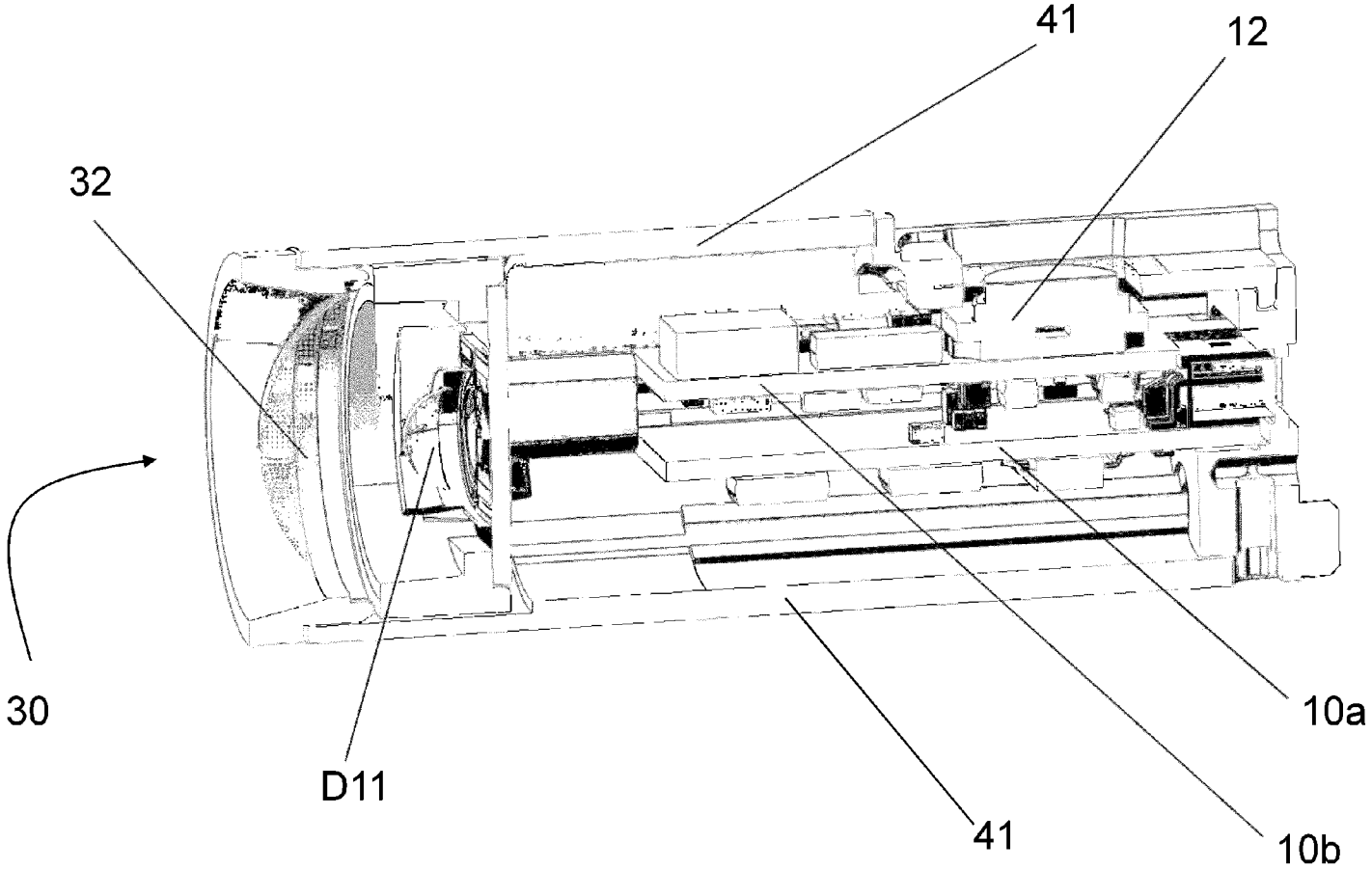
FIG. 5 is a 3D sectional view of a light-emitting diode module having an axial light exit opening.
Figure 6:
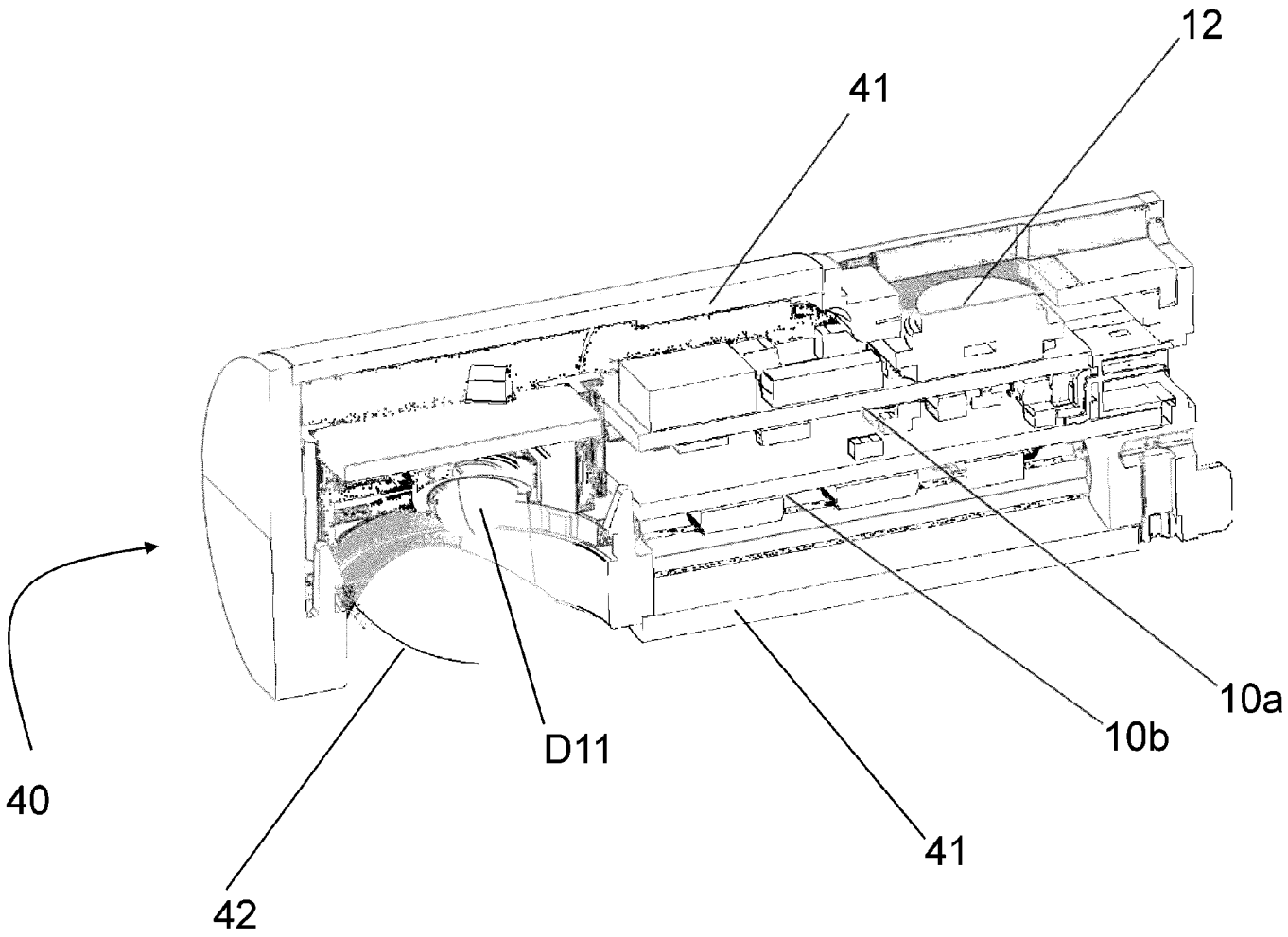
FIG. 6 is a 3D sectional view of a light-emitting diode module having an radial light exit opening.

Appropriate housings are shown in FIGS. 5 and 6. FIG. 5 shows a light-emitting diode module 30 having an axial light exit opening. Module 30 comprises a housing 41 made of aluminum enclosing a light-emitting diode D11 and a lens 32. The electronic circuit including the wide range voltage module is built on two circuit boards, 10*a* and 10*b*, which are electrically and mechanically connected by a flexible portion, not illustrated, and thus form a foldable printed circuit board unit. FIG. 6 shows an alternative light-emitting diode module 40 which has a radially aligned light exit opening with a lens 42.

Voltage supply circuit S1 additionally includes a mandatory reverse polarity protection circuit S3 which is arranged upstream the comparator circuit S4 in the circuit diagram. Usually, polarity reversal protection is implemented by a diode connected into the load circuit. In the present circuit, instead of a diode a MOS transistor V3 is connected into the load circuit, at which in the on-state thereof a much lower voltage drop and power dissipation occurs. The voltage drop is controlled by zener diode D3. Thus, when a positive input voltage is applied, a voltage drop occurs in parallel to the gate-source voltage of the transistor, so that the latter is switched on. The current flow through the diode is limited by resistor R7, so that there is no large power dissipation in this branch.

Referring to FIGS. 7 and 8, it is apparent that a light-emitting diode module including the housing and the wide range voltage module as described above is excellently suited for use in environments with high demands for maximum allowable emissions of electromagnetic interference.

Diagrams 7*a* through 7*f* illustrate the respective frequency spectra between 150 kHz and 25 MHz of space-bound interference emission.

For comparison purposes, each of the measured characteristics is compared to the allowable limits as specified in the D6-36440 specification.

Figure 7A:
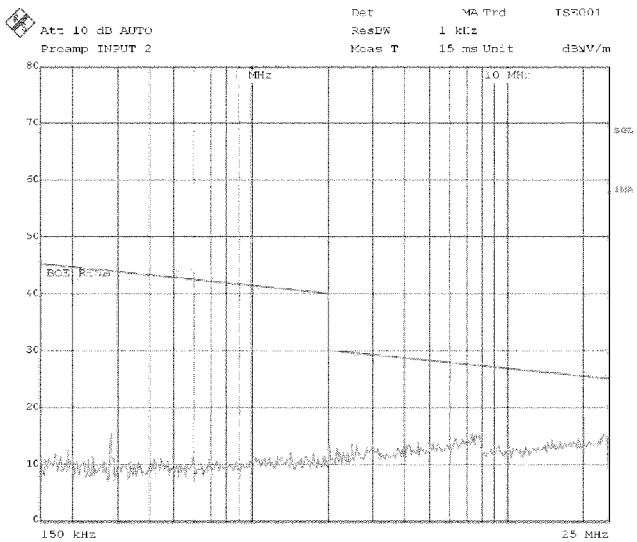
FIG. 7 shows a measurement diagram of space-bound interference emission in a frequency range between 150 kHz and 25 MHz.

FIG. 7*a* shows the interference emission of a light-emitting diode module at full light output and a supply voltage of 5 V.

Figure 7B:
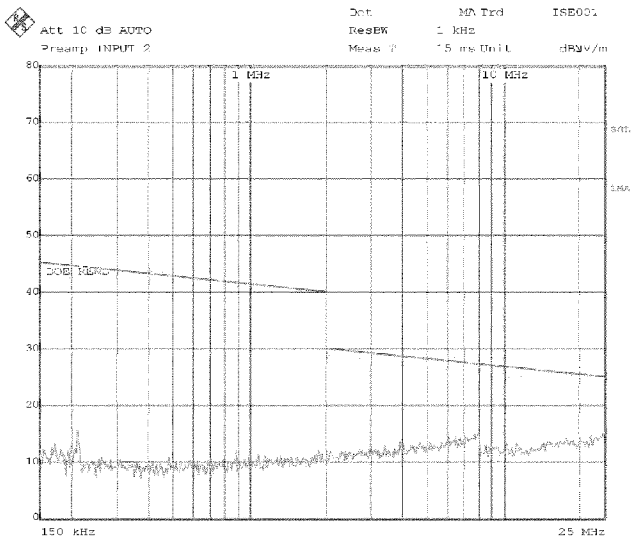
Figure 7C:
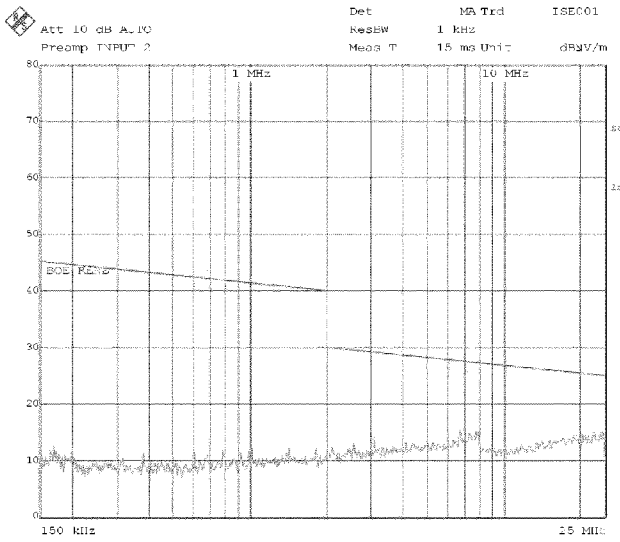
Figure 7D:
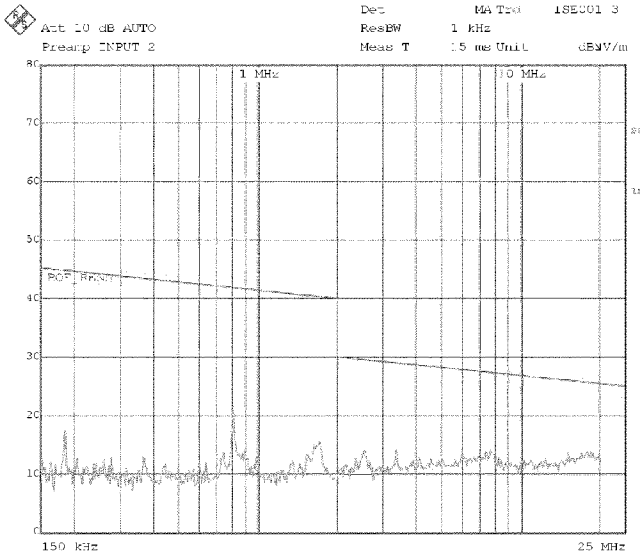
Figure 7E:
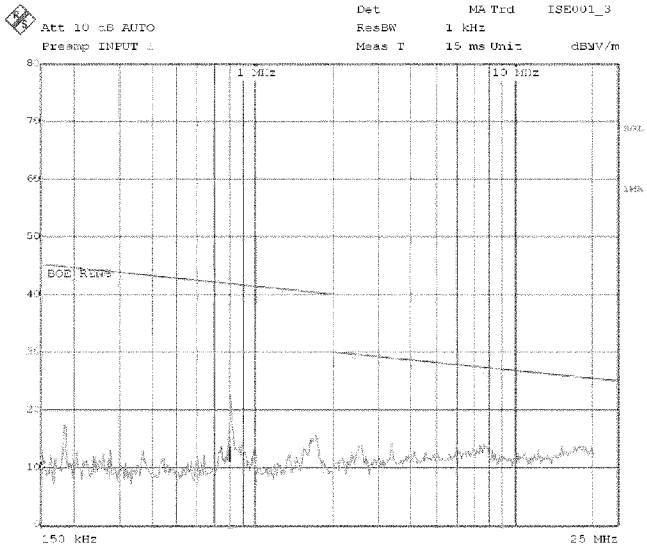
Figure 7F:
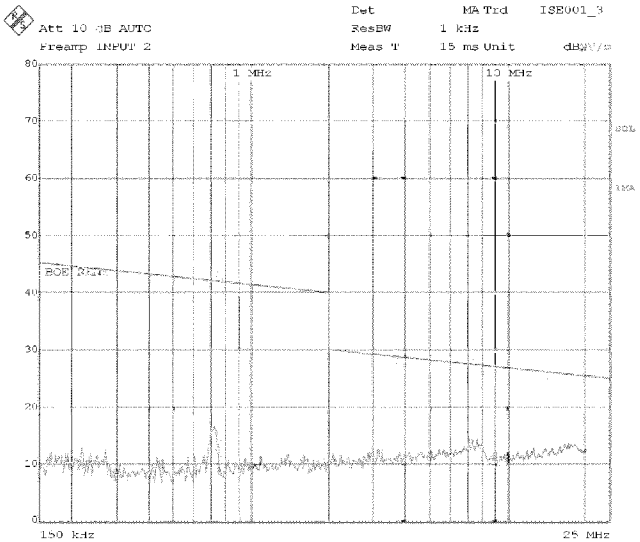

The measurements illustrated in FIGS. 7*b* to 7*d* were each performed at a voltage of 28 V. FIGS. 7*b* and 7*d* show the spectra at full brightness, in diagram 7*d* the wide range voltage module has been measured without the housing.

The measurement of graph 7*c* was performed at 60% brightness of the light-emitting diode. Graphs 7*e* and 7*f* show further measurement results of the wide range voltage module without housing.

FIGS. 8*a* through 8*d* show the wire-bound interference emissions of the light-emitting diode module.

Graph 8*a* shows the spectrum at an input voltage of 5 V; graphs 8*b* to 8*d* show the respective frequency spectrum at an input voltage of 28 V DC.

Figure 8A:
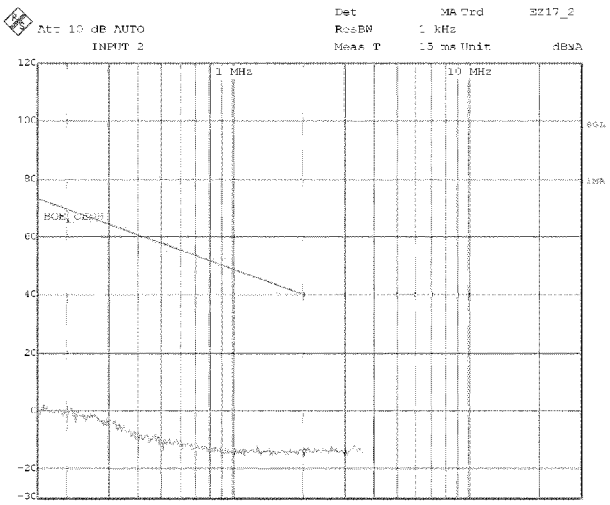
FIG. 8 shows a measurement diagram of wire-bound interference emission in a frequency range between 150 kHz and 25 MHz.
Figure 8B:
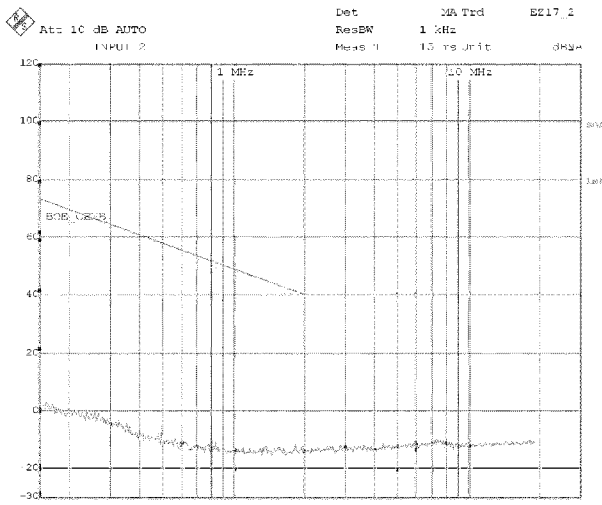

The measurements illustrated in FIGS. 8*a* and 8*b* were performed at full light output of the light-emitting diode module.

Figure 8C:
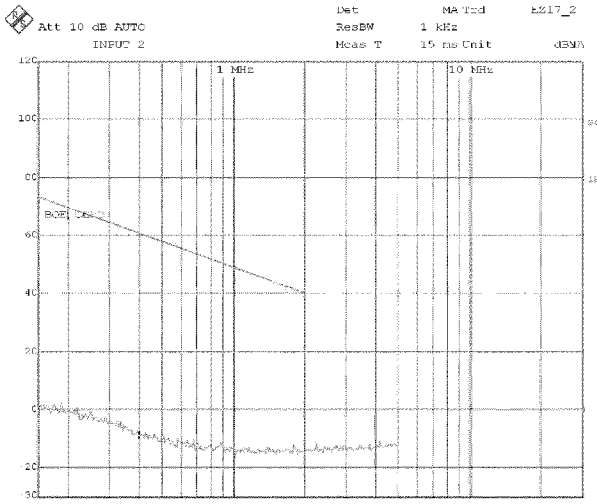
Figure 8D:
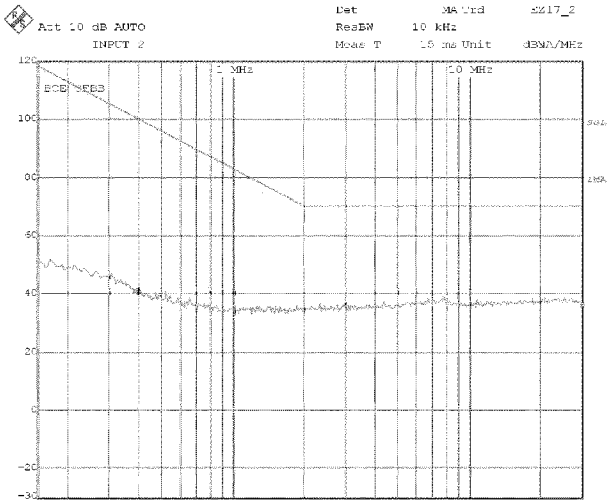

The measurements of FIGS. 8*c* and 8*d* were performed at 60% of the maximum light output.

As can be seen from all figures, the measurement results are clearly below the specified permissible limits.

Figure 9:
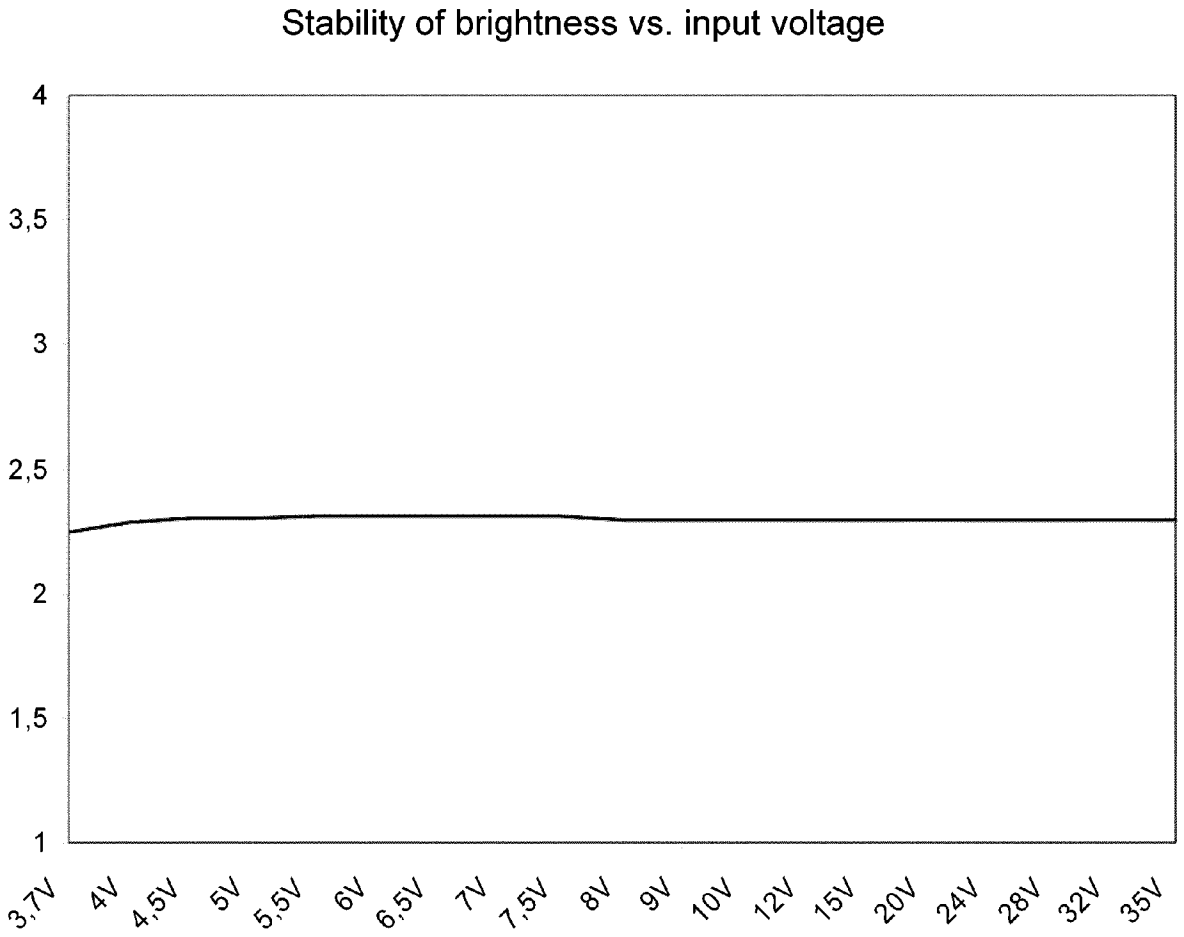
FIG. 9 shows a measurement diagram illustrating the stability of brightness versus input voltage.

FIG. 9 illustrates the stability of the brightness of a light-emitting diode module in function of the input voltage between 3.7 V and 35 V, which shows only surprisingly small changes in brightness.

The invention claimed is:

1. A light-emitting diode module, comprising:

a housing;

at least one light-emitting diode; and at least one printed circuit board including an LED driver, a control module, and a circuit arrangement, the at least one printed circuit board being connected with the at least one light-emitting diode, wherein the LED driver provides an operating point for operation of the at least one light-emitting diode controlled by the control module, wherein the circuit arrangement comprises a DC/DC converter, wherein the DC/DC converter is an integrated down-converter and the circuit arrangement further comprises a bypass circuit connected in parallel to the integrated down-converter, the bypass circuit being controlled by a comparator circuit, and wherein the comparator circuit enables the bypass circuit when an input voltage applied to the circuit arrangement falls below a first threshold value and disables the bypass circuit when the input voltage exceeds a second threshold value.

2. The light-emitting diode module as claimed in claim 1, wherein the comparator circuit comprises at least a first transistor, a first resistor, a second resistor, and a zener diode, and wherein the first resistor is connected in parallel with a base-emitter diode of the first transistor and provides a division ratio with the second resistor such that, if the level of the input voltage is above the second threshold value, a base-emitter voltage drop at the first resistor is sufficient to switch the first transistor on, and such that, if the level of the input voltage is below the first threshold value, the first transistor is blocked and enables the bypass circuit.

3. The light-emitting diode module as claimed in claim 2, wherein the comparator circuit comprises a third resistor connected to the first resistor and the bypass circuit so that, when the bypass circuit is enabled, the third resistor forms a parallel circuit with the first resistor, so that the division ratio changes and the threshold voltage for disabling the bypass circuit increases.

4. The light-emitting diode module as claimed in claim 3, wherein the comparator circuit comprises circuit having a second transistor, a voltage divider, and a capacitor, wherein the capacitor is adapted, in case of high frequency signals superimposed on the input DC voltage, to de-tune the voltage divider so that a supply voltage for the first transistor is blocked.

5. The light-emitting diode module as claimed in claim 1, wherein the bypass circuit comprises a field effect transistor with a gate that is controlled by the comparator circuit.

6. The light-emitting diode module as claimed in claim 1, wherein the control module is a PWM module or a semiconductor switch, the control module being actuatable by a separate switch or a pushbutton or an external switching input.

7. The light-emitting diode module as claimed in claim 1, wherein the control module is a mechanical switch.

8. The light-emitting diode module as claimed in claim 1, wherein the circuit arrangement includes an overvoltage protection circuit having a field effect transistor that limits supply voltage in case of an overvoltage.

9. The light-emitting diode module as claimed in claim 1, wherein the circuit arrangement includes a reverse polarity protection circuit having a field effect transistor, a diode, and a resistor, wherein the field effect transistor is arranged between an input of the circuit arrangement and the comparator circuit.

10. The light-emitting diode module as claimed in claim 9, wherein the circuit arrangement comprises a first filter circuit arranged between the input and the comparator circuit.

11. The light-emitting diode module as claimed in claim 10, wherein the circuit arrangement comprises a second filter circuit arranged between the DC/DC converter and the comparator circuit.

12. The light-emitting diode module as claimed in claim 10, further comprising at least one suppressor diode and/or at least one varistor arranged between the input and the first filter circuit.

13. The light-emitting diode module as claimed in claim 10, further comprising a plurality of suppressor diodes and/or varistors arranged at the output side and/or input side of the at least one light-emitting diode and of other components of the LED printed circuit board, between the input and the first filter circuit, and/or between the input and the LED driver.

14. The light-emitting diode module as claimed in claim 5, further comprising a first diode is arranged between an output of the circuit arrangement and the transistor, and a second diode arranged between the output and the converter module.

15. The light-emitting diode module as claimed in claim 1, wherein the circuit board is a multi-part rigid circuit board, the circuit board parts being connected by flexible sections of conductive traces and being enclosed in the housing in folded relationship.

16. The light-emitting diode module as claimed in claim 1, wherein the light-emitting diode module is used for aviation purposes.

17. The light-emitting diode module as claimed in claim 1, wherein the light-emitting diode module is used in reading lights or light source arrangements for coupling light into light-guiding media.

18. The light-emitting diode module as claimed in claim 1, wherein the light-emitting diode module is used in or for medical-technology equipment.

19. The light-emitting diode module as claimed in claim 1, wherein the LED driver provides a constant operating point with a voltage range between 4.5 V and 32.5 V.

20. The light-emitting diode module as claimed in claim 1, wherein the circuit arrangement provides a hysteresis for enabling and/or disabling the bypass circuit.

21. The light-emitting diode module as claimed in claim 20, wherein the hysteresis is 0.5 V.

22. The light-emitting diode module as claimed in claim 1, wherein the second threshold value is greater than the first threshold value.

23. A light-emitting diode module, comprising:

a housing;

at least one light-emitting diode; and at least one printed circuit board including an LED driver, a control module, and a circuit arrangement, the at least one printed circuit board being connected with the at least one light-emitting diode, wherein the LED driver provides an operating point for operation of the at least one light-emitting diode controlled by the control module, wherein the circuit arrangement comprises a DC/DC converter, wherein the DC/DC converter is an integrated down-converter and the circuit arrangement further comprises a bypass connected in parallel to the integrated down-converter, the bypass being activatable by a comparator circuit, wherein the comparator circuit can detect a level of an input voltage applied to the circuit arrangement, to activate the bypass when the level is below a threshold value, and to deactivate the bypass when the level exceeds the threshold value, and wherein the comparator circuit comprises at least a first transistor, a first resistor, a second resistor, and a zener diode, and wherein the first resistor is connected in parallel with a base-emitter diode of the first transistor and provides a division ratio with the second resistor such that, if the level of the input voltage is above the threshold value, a base-emitter voltage drop at the first resistor is sufficient to switch the first transistor on, and such that, if the level of the input voltage is below the threshold value, the first transistor is blocked and activates the bypass.

24. The light-emitting diode module as claimed in claim 23, wherein the comparator circuit comprises a third resistor connected to the first resistor and the bypass so that, when the bypass is activated, the third resistor forms a parallel circuit with the first resistor, so that the division ratio changes and the threshold voltage for deactivating the bypass increases.

25. The light-emitting diode module as claimed in claim 24, wherein the comparator circuit comprises circuit having a second transistor, a voltage divider, and a capacitor, wherein the capacitor is adapted, in case of high frequency signals superimposed on the input DC voltage, to de-tune the voltage divider so that a supply voltage for the first transistor is blocked.

26. A light-emitting diode module, comprising:

a housing;

at least one light-emitting diode;

at least one printed circuit board including an LED driver, a control module, and a circuit arrangement, the at least one printed circuit board being connected with the at least one light-emitting diode, wherein the LED driver provides an operating point for operation of the at least one light-emitting diode controlled by the control module, wherein the circuit arrangement comprises a DC/DC converter, wherein the DC/DC converter is an integrated down-converter and the circuit arrangement further comprises a bypass connected in parallel to the integrated down-converter, the bypass being activatable by a comparator circuit, and wherein the comparator circuit can detect a level of an input voltage applied to the circuit arrangement, to activate the bypass when the level is below a threshold value, and to deactivate the bypass when the level exceeds the threshold value, wherein the circuit arrangement includes a reverse polarity protection circuit having a field effect transistor, a diode, and a resistor, wherein the field effect transistor is arranged between an input of the circuit arrangement and the comparator circuit, wherein the circuit arrangement comprises a first filter circuit arranged between the input and the comparator circuit; and a plurality of suppressor diodes and/or varistors arranged at the output side and/or input side of the at least one light-emitting diode and of other components of the LED printed circuit board, between the input and the first filter circuit, and/or between the input and the LED driver.

27. A light-emitting diode module, comprising:

a housing;

a light-emitting diode; and a printed circuit board connected with the light-emitting diode, the printed circuit board including an LED driver, a control module, and a circuit arrangement, wherein the LED driver provides a constant operating point for operation of the light-emitting diode controlled by the control module, the constant operating point having a voltage range between 4.5 V and 32.5 V, wherein the circuit arrangement comprises an integrated down-converter, a bypass circuit, and a comparator circuit, the bypass circuit and the integrated down-converter being connected to the control module in parallel, and wherein the comparator circuit enables the bypass circuit when an input voltage applied to the circuit arrangement falls below a first threshold value of 7.5 V to supply the input voltage to the control module via the bypass circuit and disables the bypass circuit when the input voltage exceeds a second threshold value of 8.0 V to supply the input voltage to the control module via the integrated down-converter.

* * * * *